US010884372B2

(12) United States Patent
Tamura et al.

(10) Patent No.: US 10,884,372 B2
(45) Date of Patent: Jan. 5, 2021

(54) IMAGE FORMING APPARATUS INCLUDING OPTICAL PRINT HEAD

(71) Applicant: CANON KABUSHIKI KAISHA, Tokyo (JP)

(72) Inventors: Yuya Tamura, Tsukuba (JP); Takehiro Ishidate, Tokyo (JP); Hitoshi Iwai, Abiko (JP); Yuta Okada, Moriya (JP); Toshiki Momoka, Tokyo (JP); Shinichiro Hosoi, Tokyo (JP); Daisuke Aruga, Abiko (JP); Shinichiro Kaikawa, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/698,754

(22) Filed: Nov. 27, 2019

(65) Prior Publication Data

US 2020/0174420 A1 Jun. 4, 2020

(30) Foreign Application Priority Data

Dec. 4, 2018 (JP) ..... 2018-227474

(51) Int. Cl.
*G03G 21/16* (2006.01)

(52) U.S. Cl.
CPC ..... *G03G 21/1647* (2013.01); *G03G 21/1666* (2013.01); *G03G 21/1676* (2013.01)

(58) Field of Classification Search
CPC ..... G03G 21/1647; G03G 21/1666; G03G 21/1676; G03G 21/18; G03G 21/162; G03G 21/1633
See application file for complete search history.

(56) References Cited

U.S. PATENT DOCUMENTS

2009/0202272 A1* 8/2009 Nakashima ..... G03G 15/326 399/117
2010/0021200 A1* 1/2010 Kato ..... G03G 15/04 399/111
2011/0255905 A1* 10/2011 Yokoi ..... G03G 15/04036 399/220

(Continued)

FOREIGN PATENT DOCUMENTS

JP 2013-61577 A 4/2013
JP 2013-225057 A 10/2013
JP 2017-215567 A 12/2017

*Primary Examiner* — Francis C Gray
(74) *Attorney, Agent, or Firm* — Canon U.S.A., Inc. IP Division

(57) ABSTRACT

An image forming apparatus includes a cover pivotable on a body to close an opening at a closed position and open the opening at an open position, first and second replacement units having photosensitive drums, an optical print head pivotable in one direction, a spring, and a stopper. The spring applies, to the optical print head, a force for allowing the optical print head to pivot toward the one direction so that a movement of the optical print head with a pivotal movement of the cover from the open position to the closed position is prevented from being inhibited by the first developing cartridge. The optical print head, having the force applied the optical print head by the spring, so that movement of the optical print head with pivotal movement of the cover from the open to the closed position is prevented from being inhibited by the second developing cartridge.

8 Claims, 8 Drawing Sheets

(56) References Cited

U.S. PATENT DOCUMENTS

| | | | | |
|---|---|---|---|---|
| 2013/0259521 | A1* | 10/2013 | Sugiyama | G03G 21/1666 399/110 |
| 2013/0278705 | A1* | 10/2013 | Nakamura | B41J 2/325 347/238 |
| 2014/0064781 | A1* | 3/2014 | Hashimoto | G03G 21/1666 399/110 |
| 2018/0095406 | A1* | 4/2018 | Sato | G03G 21/1666 |
| 2018/0095407 | A1* | 4/2018 | Tsukada | G03G 21/1628 |
| 2018/0173133 | A1* | 6/2018 | Tsukada | G03G 15/04054 |

* cited by examiner

IMAGE FORMING APPARATUS INCLUDING OPTICAL PRINT HEAD

BACKGROUND

Field

The present disclosure relates to an image forming apparatus including a cover configured to open and close an opening formed in a main body, and an optical print head provided to the cover.

Description of the Related Art

Image forming apparatus, such as a printer and a copying machine, include optical print heads each including a plurality of light emitting elements configured to expose a photosensitive drum to light. As the optical print heads, there are known optical print heads in which light emitting diodes (LEDs) and organic electro-luminescence (EL) elements are used as examples of the light emitting elements, and in which a plurality of light emitting elements are arrayed, for example, in one row or in two staggered rows, along a rotational axis direction of the photosensitive drum. Further, the optical print heads each include a plurality of lenses configured to collect light emitted from the plurality of light emitting elements on the photosensitive drum. The plurality of lenses are arranged between the plurality of light emitting elements and the photosensitive drum to be opposed to a surface of the photosensitive drum along an array direction of the light emitting elements. The light emitted from the plurality of light emitting elements is collected on the surface of the photosensitive drum through the lenses so that an electrostatic latent image is formed on the photosensitive drum.

Further, as the image forming apparatus including the optical print heads, there is known an image forming apparatus in which the optical print heads are provided to a cover that is pivotable with respect to a main body. The main body has an opening formed in an upper part thereof, and the cover covers the opening. The cover pivots about a pivotal axis on a back side of the main body. The optical print head is configured to move between an exposure position at which a photosensitive drum is exposed to light, and a retreat position at which the optical print head has retreated from the photosensitive drum with respect to the exposure position along with the pivotal movement of the cover. The optical print head is at the retreat position when the cover is opened to open the opening. Meanwhile, the optical print head is at the exposure position when the cover is closed to close the opening.

For example, an image forming apparatus described in Japanese Patent Application Laid-Open No. 2013-61577 includes a cover (second cover) configured to cover an upper part of the apparatus. The cover is rotatably mounted to a main body, and is configured to be opened or closed with a rotary movement. On the cover, the same number of exposure heads corresponding to four developing cartridges (developing units), respectively, are held with head holders (an exposure head and a head holder are hereinafter collectively referred to as "optical print head"). Each optical print head is rotatably provided to the second cover. Here, for example, when an optical print head provided closest to a front side of the main body is located at an exposure position, developing cartridges are arranged adjacent to the optical print head on the back side and the front side thereof. In other words, when the cover is gradually closed, the optical print head is inserted between two developing cartridges and is moved to the exposure position.

For example, when an operator such as a user or a service technician cleans the optical print head, the operator can hold and rotate the optical print head with respect to the cover so that a light exit surface of the optical print head faces the operator side in a state in which the cover is opened. When the cleaning is finished, and the operator releases the optical print head, the optical print head pivots back to a predetermined position by its own weight. When the cover is closed in a state in which the optical print head has returned to the predetermined position, the optical print head is inserted between the two developing cartridges, and is moved to the exposure position.

However, for example, when dust settles at a mounting portion between the optical print head and the cover, slidability of the optical print head with respect to the cover is reduced. For example, in a case in which the operator holds the optical print head to rotate the optical print head from the predetermined position to the front side in order to clean the optical print head, even when the operator releases the optical print head thereafter, the optical print head may not return to the predetermined position by its own weight. When the cover is closed in the state in which the optical print head has not returned to the predetermined position, there is a fear in that the optical print head may not be inserted between the two adjacent developing cartridges.

SUMMARY

According to an aspect of the present disclosure, an image forming apparatus includes a main body, a cover provided on the main body to be pivotable between a closed position, at which an opening formed in the main body is closed, and an open position, at which the opening is opened, a first replacement unit that is mounted to the main body through the opening and includes a first photosensitive drum which is rotatable and a first developing cartridge containing a developer, wherein the first developing cartridge is located closer to the opening than the first photosensitive drum in a state in which the first replacement unit is mounted to the main body, a second replacement unit that mounted to the main body through the opening at a position adjacent to the first replacement unit mounted to the main body and includes a second photosensitive drum which is rotatable and a second developing cartridge containing a developer, wherein the second developing cartridge is located closer to the opening than the second photosensitive drum in a state in which the second replacement unit is mounted to the main body, an optical print head configured to expose the first photosensitive drum to light, wherein the optical print head is located outside the opening when the cover is at the open position, is located between the first developing cartridge and the second developing cartridge when the cover is at the closed position, and is provided to the cover to be pivotable in one direction which is a direction from the first developing cartridge toward the second developing cartridge in a case in which the cover is at the closed position, and to be pivotable in another direction which is opposite to the one direction, a spring configured to apply, to the optical print head, a force for allowing the optical print head to pivot toward the one direction so that a movement of the optical print head with a pivotal movement of the cover from the open position to the closed position is prevented from being inhibited by the first developing cartridge, and a stopper, wherein the optical print head, having the force applied the optical print head by the spring, abuts the stopper toward the one direction so that the movement of the optical print head with the pivotal movement of the cover from the open position to the closed position is prevented from being inhibited by the second developing cartridge.

Further features of the present disclosure will become apparent from the following description of exemplary embodiments with reference to the attached drawings.

DESCRIPTION OF THE EMBODIMENTS

Now, an embodiment of the present disclosure is described with reference to the accompanying drawings. However, constituting elements described in this description are merely examples, and are not intended to limit the present disclosure to the embodiment described in this description.

(Overall Configuration of Image Forming Apparatus)

Figure 1:
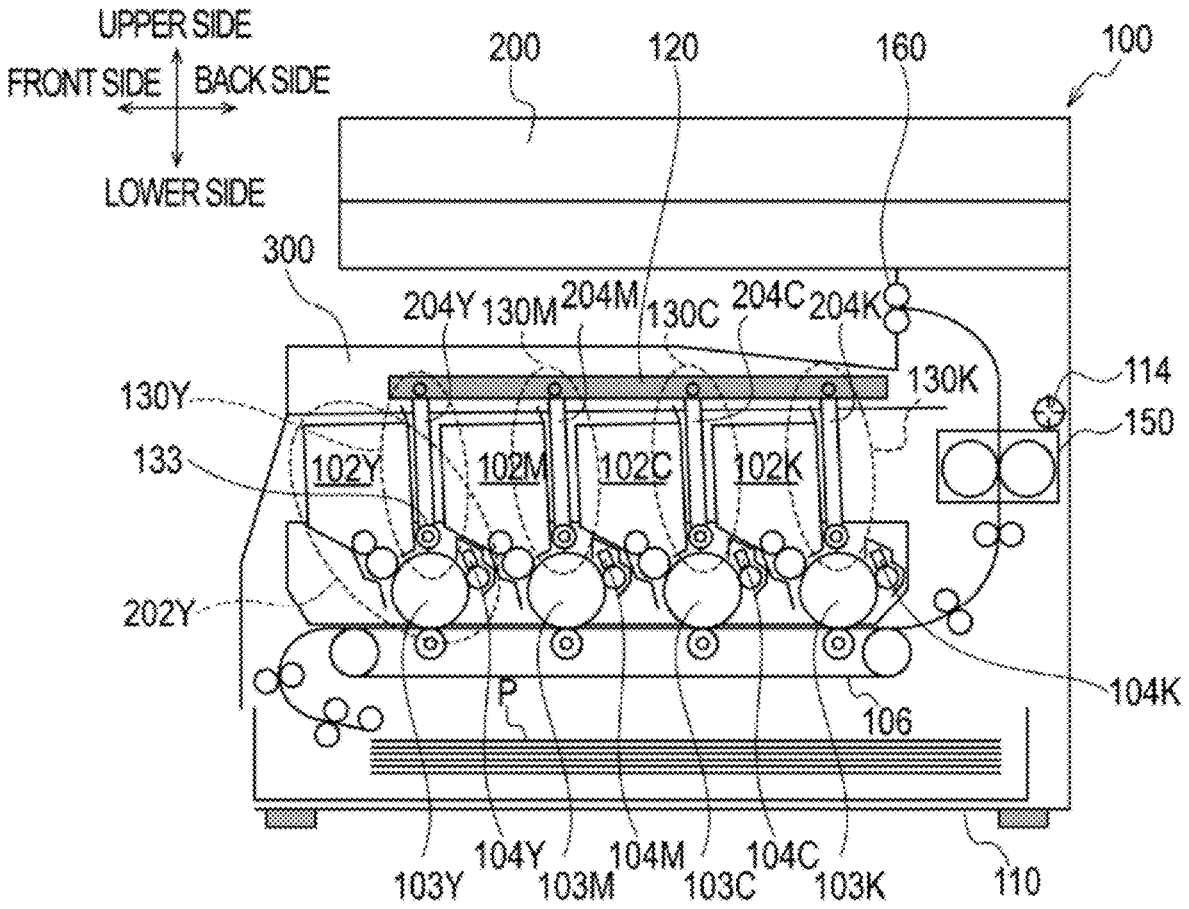
FIG. 1 is a schematic sectional view of an image forming apparatus in a state in which a cover is closed.

First, a schematic configuration of an image forming apparatus 100 is described. FIG. 1 is a schematic sectional view of the image forming apparatus 100. The image forming apparatus 100 illustrated in FIG. 1 is a copying machine including a reading apparatus 200, but the embodiment may relate to a color printer (single function printer; SFP) without the reading apparatus 200. This embodiment relates to what is called a tandem color image forming apparatus including a plurality of photosensitive drums 103 as illustrated in FIG. 1.

The image forming apparatus 100 illustrated in FIG. 1 includes photosensitive drums 103Y, 103M, 103C, and 103K (hereinafter also collectively referred to as "photosensitive drums 103") corresponding to the colors of yellow, magenta, cyan, and black, respectively. The photosensitive drums are arrayed at intervals.

As illustrated in FIG. 1, in the following description, the side on which the photosensitive drum 103Y corresponding to yellow is arranged with respect to the photosensitive drum 103K corresponding to black is defined as "front side". Further, the side on which the photosensitive drum 103K corresponding to black is arranged with respect to the photosensitive drum 103Y corresponding to yellow is defined as "back side". Further, as illustrated in FIG. 1, an upper side as indicated on the drawing sheet is defined as "upper side" in a vertical direction, and a lower side is defined as "lower side" in the vertical direction. The photosensitive drums 103Y to 103K are arrayed from the front side to the back side.

The image forming apparatus 100 includes charging devices 104Y, 104M, 104C, and 104K (hereinafter also collectively referred to as "charging devices 104") configured to charge the photosensitive drums 103Y, 103M, 103C, and 103K, respectively. Moreover, the image forming apparatus 100 includes optical print heads 130Y, 130M, 130C, and 130K (hereinafter also collectively referred to as "optical print heads 130") as exposure light sources configured to emit light to which the photosensitive drums 103Y, 103M, 103C, and 103K are exposed, respectively. Each of the optical print heads 130 has an elongated shape extending in a rotational axis direction of the photosensitive drums 103. The image forming apparatus 100 illustrated in FIG. 1 is an image forming apparatus adopting what is called an upper-surface exposure method", in which the photosensitive drums 103 are exposed to light from above in the vertical direction.

Examples of an exposure method adopted in electrophotographic image forming apparatus include a laser beam scanning exposure method, in which emission beams of a semiconductor laser are scanned by a rotating polygon mirror or the like to expose photosensitive drums to light through an f–θ lens or the like. The "optical print heads 130" as described in this embodiment are used in an LED exposure method, in which light emitting elements, such as LEDs, arrayed along the rotational axis direction of the photosensitive drums 103 are used to expose the photosensitive drums 103 to light, and are not used in the above-mentioned laser beam scanning exposure method.

In this embodiment, the light emitting elements are semiconductor light emitting diodes (LEDs), but may be, for example, organic light emitting diodes (OLEDs). The OLEDs are also called as "organic electro-luminescence (organic EL)" elements, and are current-driven light emitting elements. The OLEDs are arranged in line along a main scanning direction (rotational axis direction of the photosensitive drums 103) on, for example, a thin film transistor (TFT) substrate and are electrically connected in parallel to each other by a power supply wiring provided also along the main scanning direction.

The image forming apparatus 100 further includes developing cartridges 102Y, 102M, 102C, and 102K (hereinafter also collectively referred to as "developing cartridges 102") including developing devices configured to develop the electrostatic latent images on the photosensitive drums 103 with toner, and hence develop toner images of respective colors on the photosensitive drums 103. The letters "Y", "M", "C", and "K" added to the reference numerals indicate colors of toner. The developing cartridges 102 are configured to contain toner as an example of a developer.

As illustrated in FIG. 1, the image forming apparatus 100 is an image forming apparatus adopting a direct transfer method, in which the toner images formed on the photosensitive drums 103 are directly transferred onto a recording sheet P. Therefore, the image forming apparatus 100 includes a conveyance belt 106 (an example of a belt) configured to convey the recording sheet P to the photosensitive drums 103. The conveyance belt 106 is an endless belt provided on a lower side of the photosensitive drums 103 to be opposed to the photosensitive drums 103. In the case of the direct transfer method using the conveyance belt 106, through electrostatic adsorption of the sheet P by the conveyance belt 106, even when a diameter of the photosensitive drums 103 is large, separation from the photosensitive drums 103 is reliably performed, and stable sheet conveyance is enabled. In this method, the sheet P and the conveyance belt 106 are strongly electrostatically adsorbed to each other, and hence the following disadvantages are pointed out: failure of separation from the conveyance belt 106 and image irregularities due to separation discharge are liable to occur. Embodiments of the present disclosure are not limited to the above-mentioned direct transfer method, and may adopt, for example, what is called an intermediate transfer method, in which the toner images are transferred onto an intermediate transfer belt, and then the toner images are transferred again onto the recording sheet P.

In the case in which the method in which the developed toner images are directly transferred onto the sheet P, which has been conveyed by the conveyance belt 106, via the photosensitive drums 103 is adopted as in this embodiment, a process cartridge 202 (an example of replacement units) has a configuration in which the developing cartridge 102 is arranged on the front side with respect to the photosensitive drum 103. Specifically, in a state in which a cover 300 is closed, the developing cartridge 102Y, the optical print head 130Y, the developing cartridge 102M, the optical print head 130M, the developing cartridge 102C, the optical print head 130C, the developing cartridge 102K, and the optical print head 130K are arranged in the stated order from the front side to the back side of the image forming apparatus 100. As a matter of course, the developing cartridge 102K and the optical print head 130K, which correspond to black, may be arranged closest to the front side. Specifically, the developing cartridges 102 and the optical print heads 130 may be arranged in order of black, yellow, magenta, and cyan from the front side to the back side of the image forming apparatus 100.

Meanwhile, in the case in which the intermediate transfer method using the intermediate transfer belt is adopted instead of the direct transfer method, a positional relationship between the process cartridge 202 and the optical print head 130 corresponding thereto is opposite to the positional relationship in this embodiment. As a specific configuration of the process cartridge 202, the developing cartridge 102 is arranged on the back side with respect to the photosensitive drum 103. More specifically, in the state in which the cover 300 is closed, the optical print head 130Y, the developing cartridge 102Y, the optical print head 130M, the developing cartridge 102M, the optical print head 130C, the developing cartridge 102C, the optical print head 130K, and the developing cartridge 102K are arranged in the stated order from the front side to the back side of the image forming apparatus 100. With this arrangement, in the configuration in which a conveyance path is located on the back side of a main body housing 110 (main body of the image forming apparatus 100), what is called a secondary transfer portion configured to transfer the toner images from the intermediate transfer belt to the sheet can also be positioned on the back side of the main body housing 110. As a matter of course, the optical print head 130K and the developing cartridge 102K, which correspond to black, may be arranged closest to the front side. Specifically, the optical print heads 130 and the developing cartridges 102 may be arranged in order of black, yellow, magenta, and cyan from the front side to the back side of the image forming apparatus 100.

Next, an image forming process is briefly described taking a process in which a yellow toner image is transferred onto the sheet P as an example. The optical print head 130Y exposes the surface of the photosensitive drum 103Y charged by the charging device 104Y to light. As a result, an electrostatic latent image is formed on the photosensitive drum 103Y. Next, a developing device included in the developing cartridge 102Y develops the electrostatic latent image formed on the photosensitive drum 103Y with yellow toner. After that, the yellow toner image developed on the surface of the photosensitive drum 103Y is transferred onto the recording sheet P. Magenta, cyan, and black toner images are also sequentially transferred onto the recording sheet P in a similar image forming process.

A fixing device 150 is configured to fix the toner images on the recording sheet P with heat and pressure. The recording sheet P that has undergone the fixing processing by the fixing device 150 is discharged from a delivery portion 160. The recording sheet P discharged from the delivery portion 160 is placed on an upper surface of the cover 300.

The image forming apparatus 100 includes the main body housing 110 and the cover 300. The main body housing 110 is a housing accommodating the conveyance belt 106, the fixing device 150, and the like. The housing including an exterior cover is herein referred to as "main body housing 110". The cover 300 includes a frame made of metal as a part thereof in order to increase its strength. The cover 300 may be formed of one metal plate to impart the strength. The cover 300 is provided in an upper part of the main body housing 110, and is configured to pivot with respect to the main body housing 110. In this embodiment, the cover 300 includes the reading apparatus 200 in an upper part thereof. The image forming apparatus 100 has a configuration in which the reading apparatus 200 pivots along with the cover 300 with respect to the main body housing 110.

Figure 2:
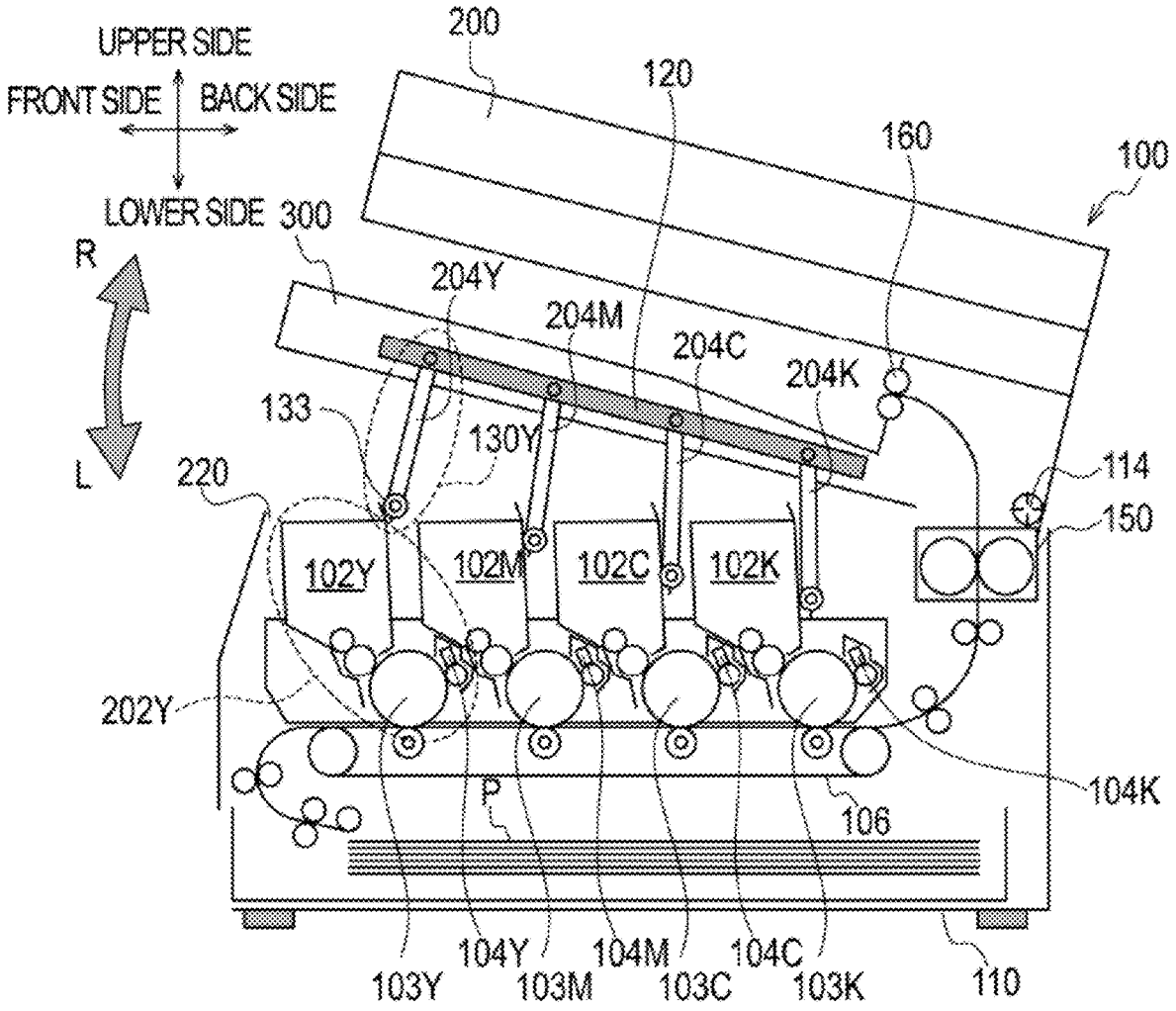
FIG. 2 is a schematic sectional view of the image forming apparatus in a state in which the cover is opened.

FIG. 2 is an illustration of the image forming apparatus 100 in the state in which the cover 300 is opened. As illustrated in FIG. 2, an opening 220 is formed on the upper side of the main body housing 110 in the vertical direction. The cover 300 pivots with a pivotal center axis 114, which is provided to the main body housing 110, as a pivotal center to be movable between a position at which the opening 220 is closed and a position at which the opening 220 is opened. A pivotal center axis of the cover 300 matches with the pivotal center axis 114. Here, the position of the cover 300 at which the opening is closed is defined as "closed position", and the position of the cover 300 at which the opening is opened is defined as "open position". When the cover 300 is at the closed position, it is not required that the cover completely cover and block the opening 220, and, for example, a through hole may be formed in a part of the cover 300. Further, a gap may be formed between the opening 220 and the cover 300 so that a part of the opening 220 is exposed. Further, a direction of the pivotal movement at the time when the cover 300 pivots from the closed position to the open position is defined as "opening direction", and a direction of the pivotal movement at the time when the cover 300 pivots from the open position to the closed position is defined as "closing direction". A direction indicated by the arrow R in FIG. 2 is the opening direction, and a direction indicated by the arrow L is the closing direction.

The pivotal center axis of the cover 300 in this embodiment is a direction substantially corresponding to a rotational center axis of each photosensitive drum 103 in a state in which the process cartridge 202 is mounted to the main body housing 110. However, the cover 300 may be mounted to the main body housing 110 so that its pivotal center axis substantially corresponds to a direction extending in an array direction of the plurality of photosensitive drums 103. Specifically, a direction of the pivotal center axis of the cover 300 may correspond to a direction that is perpendicular to both of the vertical direction and the rotational axis direction of each photosensitive drum 103 at the time when the process cartridge 202 is mounted to the main body housing 110.

As illustrated in FIG. 2, the process cartridge 202 is mounted to and removed from the main body housing 110 in the state in which the cover 300 is opened. When the process cartridge 202 is mounted to and removed from the main body housing 110, the process cartridge 202 is mounted and removed through the opening 220. In other words, when the process cartridge 202 is removed from the main body housing 110 by an operator such as a user or a service technician, and when the process cartridge 202 is mounted to the main body housing 110, the process cartridge 202 passes through the opening 220. In the state in which the cover 300 is closed, the cover 300 blocks a path along which the process cartridge 202 passes through the opening 220. In contrast, in the state in which the cover 300 is opened, the path along which the process cartridge 202 passes through the opening 220 is opened. In the state in which the cover 300 is closed, it is not required that the opening 220 be completely closed as long as the above-mentioned path along which the process cartridge 202 passes through the opening 220 is blocked. The position of the cover 300 at the time when the path along which the process cartridge 202 passes through the opening 220 is blocked by the cover 300 is defined herein as "closed position". In contrast, the position of the cover 300 at the time when the cover 300 is opened to open the path along which the process cartridge 202 passes through the opening 220 is defined herein as "open position".

The process cartridge 202 is a replaceable cartridge in which the photosensitive drum 103, the charging device 104, and the developing cartridge 102 are integrated. The process cartridge 202 is replaced on a regular basis by an operator. In this manner, it is only required that the "process cartridge 202" include at least the photosensitive drum 103. The photosensitive drum 103 is supported rotatably with respect to a frame member of the process cartridge 202.

The photosensitive drum 103 may be configured to be removable with respect to the process cartridge 202. With this configuration, after the operator removes the process cartridge 202 from the main body housing 110, the operator can further remove the photosensitive drum 103 from the process cartridge 202 to be replaced with a new photosensitive drum 103. As a result, only the photosensitive drum 103 can be replaced without replacement of the developing cartridge 102 and the charging device 104. As a matter of course, there may be adopted a configuration in which only the developing cartridge 102 or only the charging device 104 is replaceable. The process cartridge 202 has a configuration in which, in the state in which the process cartridge 202 is mounted to the main body housing 110, the developing cartridge 102 is located on the upper side of the photosensitive drum 103. In other words, the process cartridge 202 has a configuration in which, in the state of being mounted to the main body housing 110, the developing cartridge 102 is arranged closer to the opening 220 than the photosensitive drum 103. Further, an upper surface of the photosensitive drum 103 is exposed from the frame member of the process cartridge 202. The optical print head 130 exposes the photosensitive drum 103 to light from above.

In this example, the cover 300 illustrated in FIG. 1 and FIG. 2 pivots with the pivotal center axis 114, which extends in the direction of the rotational axis of the photosensitive drum 103, being the pivotal center. In other words, the direction of the pivotal center axis of the cover 300 matches with the direction of the rotational center axis of the photosensitive drum 103. That is, the optical print heads 130Y to 130K are arrayed in the direction perpendicular to the direction of the pivotal center axis of the cover 300. As illustrated in FIG. 1 and FIG. 2, the pivotal center axis 114 is located closer to the back side of the main body housing 110 than all the optical print heads 130.

When the cover 300 is opened further than the state illustrated in FIG. 2 and the cover 300 is at the open position, all the optical print heads 130 are located on the upper side of the opening 220 in the vertical direction. As a result, when the operator removes the process cartridge 202 from the main body housing 110, a possibility that the process cartridge 202 is brought into contact with the optical print heads 130 can be reduced.

The pivotal direction of the cover 300 is not limited to the direction illustrated in FIG. 1, and the pivotal center axis 114 may extend in a direction orthogonal to the direction of the rotational axis of the photosensitive drum 103. With this configuration, the cover 300 can move between the open position, at which the cover 300 is opened to open the opening 220, and the closed position, at which the cover 300 is closed to close the opening 220, with the pivotal center axis 114 being the pivotal center.

(Optical Print Head)

Figure 3:
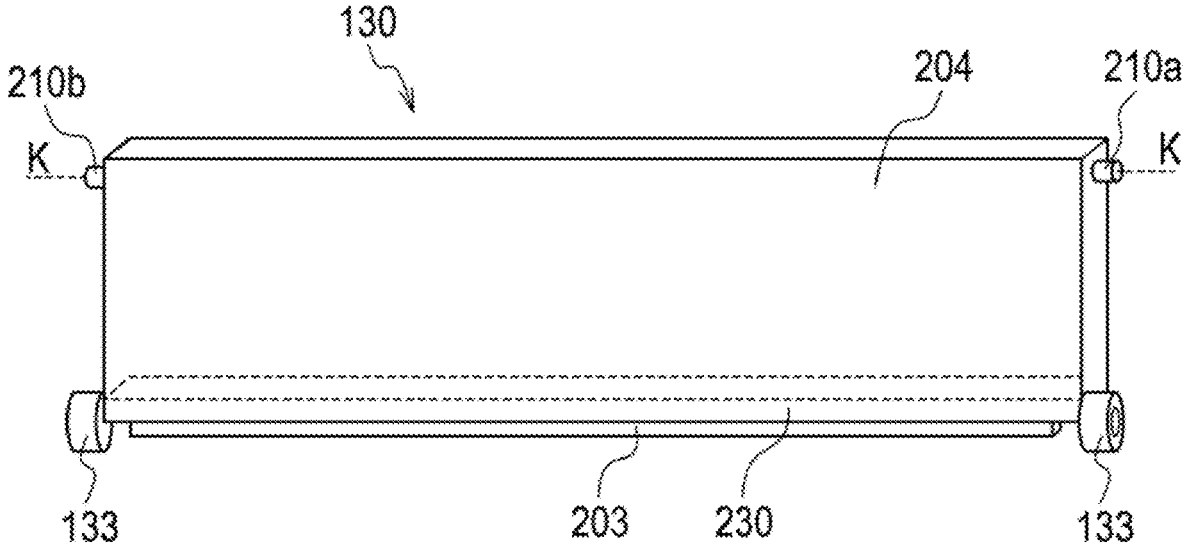
FIG. 3 is a schematic perspective view of an optical print head.

FIG. 3 is a schematic perspective view of the optical print head 130. As illustrated in FIG. 3, the optical print head 130 includes a housing 204, a substrate 230, and a lens array 203. The housing 204 is configured to hold the substrate 230 and the lens array 203. In this embodiment, the housing 204 is a molded article made of a resin by injection molding. However, the housing 204 may be a frame made of metal, which has a resin-molded member mounted to a part thereof.

On both ends of the housing 204 in a longitudinal direction of the housing 204, projections 210*a* and 210*b* are provided. The projections 210*a* and 210*b* are fitted to fitting holes (not shown) formed in the cover 300. With this configuration, the housing 204 pivots with respect to the cover 300. In this embodiment, both of the projections 210*a* and 210*b* are columnar projections, and the optical print head 130 pivots with respect to the cover 300 with a center axis K of the projections being a pivotal center. Here, the direction of the pivotal center axis K is a direction parallel to the direction of the pivotal center axis of the cover 300 with respect to the main body housing 110.

Although details are to be described later, a plurality of LED chips 201 are mounted to the substrate 230. Each LED chip 201 includes a plurality of light emitting diodes (LEDs) as light emitting elements 126. Light emitted from the light emitting elements 126 is collected on the surface of the photosensitive drum 103 through the lens array 203. The lens array 203 is provided to project from the housing 204.

On both end sides of the housing 204 in the longitudinal direction of the housing 204, rotary members 133 configured to rotate with respect to the housing 204 are provided. A rotational center axis of the rotary members 133 is an axis parallel to the pivotal center axis K of the optical print head 130 with respect to the cover 300. The rotary members 133 project more toward the side on which the photosensitive drum 103 is arranged than the lens array 203. With this configuration, the lens array 203 is not brought into contact with the photosensitive drum 103.

The rotary members 133 also have a function to form a gap between the lens array 203 and the photosensitive drum 103 through abutment against the surface of the photosensitive drum 103. An amount of the gap is a value determined based on a focal length of the lens array 203, and when a distance between the lens array 203 and the photosensitive drum 103 is accurately determined by the rotary members 133, the latent image is accurately formed on the photosensitive drum 103. The rotary member 133 rotates with respect to the housing 204, and hence rotates in association with the photosensitive drum 103 that rotates. Therefore, the rotary member 133 does not rub the surface of the photosensitive drum 103, and there is low risk that the rotary member 133 scratches on the photosensitive drum 103. With the rotary member 133 rotating in association with the photosensitive drum 103 that rotates, the distance between the lens array 203 and the photosensitive drum 103 is kept constant.

In this embodiment, the rotary members 133 are used in positioning the optical print head 130 with respect to the photosensitive drum 103, but, for example, a part of the optical print head 130 may be abutted not against the photosensitive drum 103 but against the frame member of the process cartridge 202 configured to rotatably support the photosensitive drum 103. With the photosensitive drum 103 having its position determined with respect to the frame member of the process cartridge 202, when the optical print head 130 is positioned with respect to the frame member of the process cartridge 202, the optical print head 130 can also be positioned with respect to the photosensitive drum 103. With this configuration, the optical print head 130 can be positioned with respect to the photosensitive drum 103 without the rotary members 133.

Figure 4A:
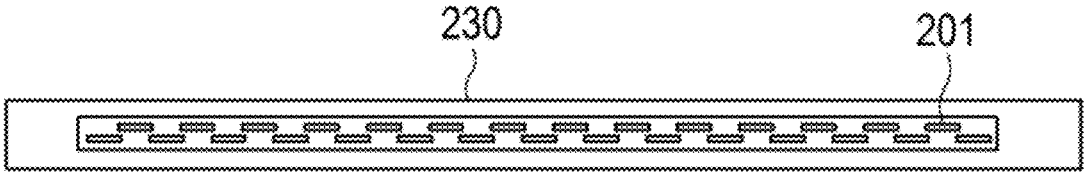
FIG. 4A, FIG. 4B, and FIG. 4C are views for illustrating a substrate and LED chips of the optical print head.
Figure 4B:
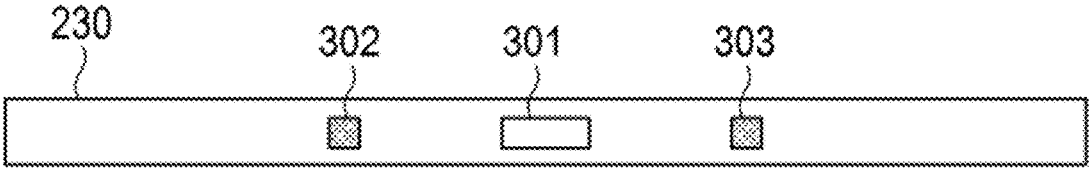
Figure 4C:
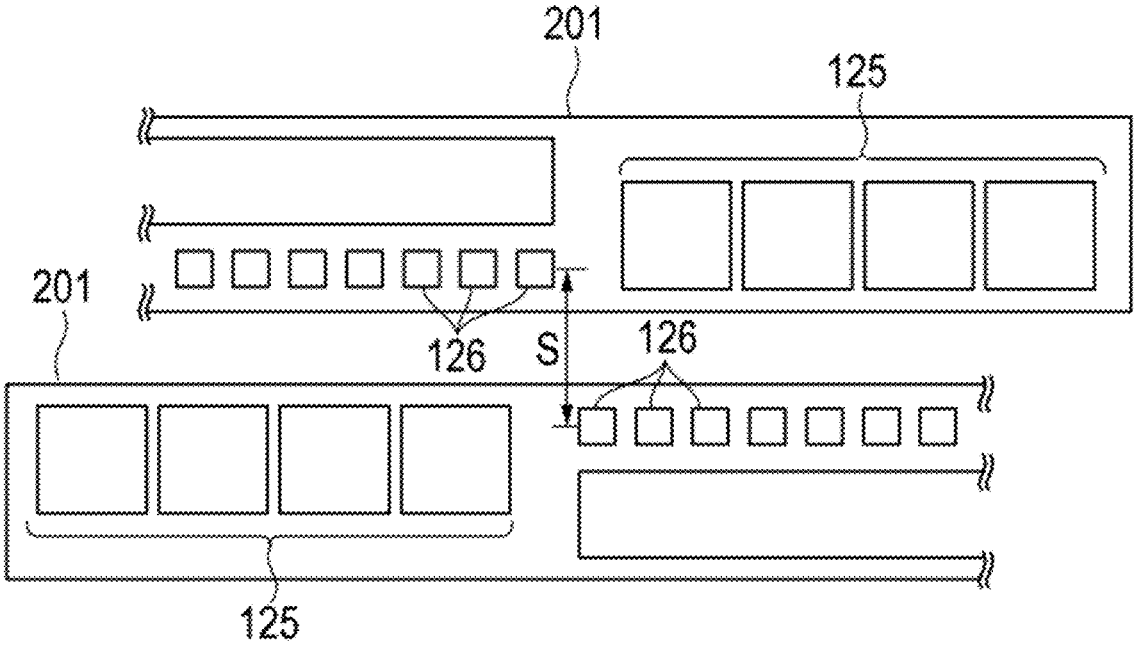

Next, a configuration of the substrate 230 is described in detail. FIG. 4A, FIG. 4B, and FIG. 4C are enlarged views of the substrate 230. FIG. 4A is an illustration of a surface (hereinafter referred to as "mounting surface") on which the LED chips 201 are mounted. Meanwhile, FIG. 4B is an illustration of a surface (hereinafter referred to as "non-mounting surface") on an opposite side to the surface on which the LED chips 201 are mounted. As illustrated in FIG. 4A, on the mounting surface, twenty-nine LED chips 201 are arranged in a staggered pattern. In each LED chip, five hundred and twelve light emitting elements 126 (LEDs) are arrayed at a predetermined resolution pitch in a longitudinal direction of the chip. The resolution of the image forming apparatus 100 in this embodiment is 1,200 dpi. Therefore, the light emitting elements 126 are arrayed in line so that a center-to-center distance between adjacent light emitting elements 126 is 21.16 micrometers (μm) in the longitudinal direction of the LED chips 201. In one LED chip 201, an end-to-end distance of the arrayed light emitting elements 126 is about 10.8 mm. With twenty-nine LED chips 201 being arrayed, the number of light emitting elements 126 that can be exposed to light is 14,848. With this configuration, an image corresponding to an image width of about 314 mm can be formed.

FIG. 4C is an illustration of a boundary portion between the LED chips 201. Wire bonding pads 125 for inputting a control signal are arranged in end portions of the LED chip 201. A signal for controlling light emission timings of the light emitting elements 126 is input from the wire bonding pads 125 to the LED chip 201. Also in the boundary portion between the chips, the pitch of the light emitting elements 126 in a longitudinal direction is 21.16 μm. Further, the LED chips 201 in two rows are arranged so that a distance (S in FIG. 4C) between light emitting points thereof is about 84 μm (4 pixels for 1,200 dpi, and 8 pixels for 2,400 dpi). On the non-mounting surface of the substrate, a drive voltage control element 302 configured to control a voltage for driving the LED chips 201, a connector 301, and a storage element 303 are arranged. The storage element 303 is configured to temporarily store information on a signal for driving the LED chips 201.

To the connector 301, signal lines for controlling the drive voltage control element 302 and the storage element 303, a power source, and a ground line are connected from a main body substrate (not shown). Wirings extending from the drive voltage control element 302 to drive the LED chips 201 pass through an internal layer of the substrate 230 to be connected to the LED chips 201.

(In Regard to Positional Relationship Between Optical Print Head and Process Cartridge)

Figure 5A:
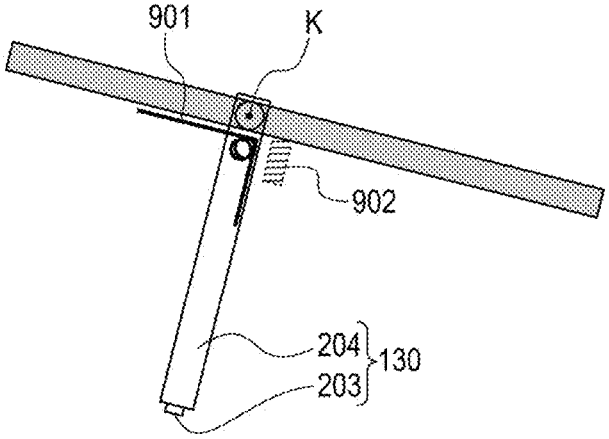
FIG. 5A and FIG. 5B are views for illustrating pivotal movement of the optical print head with respect to the cover.
Figure 5B:
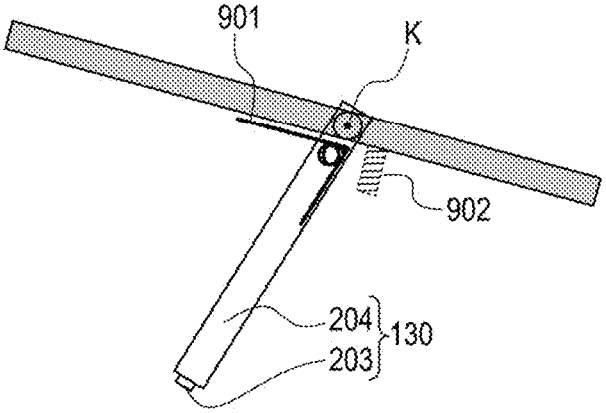
Figure 6:
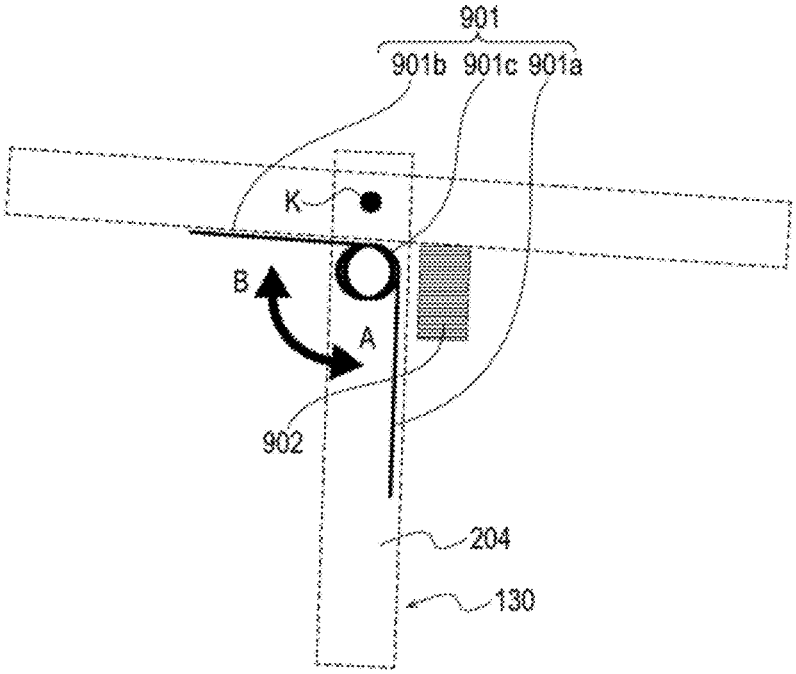
FIG. 6 is a view for illustrating functions of a spring and a stopper.

Next, with reference to FIG. 5A, FIG. 5B, and FIG. 6, the positional relationship between the optical print head 130 and the process cartridge 202 at a time when the cover 300 is gradually closed is described. For simplicity, a positional relationship between the optical print head 130Y and the process cartridge 202Y, which correspond to yellow, is described. The same applies to the optical print heads 130 and the process cartridges 202 that correspond to the other colors.

FIG. 5A is a view for illustrating a posture of the optical print head 130 with respect to the cover 300 at the time when the cover 300 is at the open position. In order to simplify the description, in FIG. 5A, the lens array 203 is illustrated without an illustration of the rotary members 133. Further, FIG. 5B is a view for illustrating a state in which, in a state in which the cover 300 is at the open position, the operator has allowed the optical print head 130 to pivot with respect to the cover 300 in order to clean a light exit surface of the optical print head 130. Also in FIG. 5B, in order to simplify the description, the lens array 203 is illustrated without an illustration of the rotary members 133.

As illustrated in FIG. 5A, the optical print head 130 pivots with respect to the cover 300 with the pivotal center axis K being the pivotal center. Further, the optical print head 130 is urged toward a stopper 902 by a spring 901. In this state, when the cover 300 is gradually closed by the operator, the optical print head 130 is moved to an exposure position at which the photosensitive drum 103 is exposed to light. Functions of the spring 901 and the stopper 902 are described later in detail.

As described above, the optical print head 130 is pivotable with respect to the cover 300 with the pivotal center axis K being the pivotal center. In this case, when the optical print head 130 is at the exposure position, which is a position for exposing the photosensitive drum 103 to light, the optical print head 130 is positioned between two adjacent developing cartridges 102. Specifically, the optical print head 130Y is positioned between the developing cartridge 102Y and the developing cartridge 102M, the optical print head 130M is positioned between the developing cartridge 102M and the developing cartridge 102C, and the optical print head 130C is positioned between the developing cartridge 102C and the developing cartridge 102K.

In order to describe the pivotal movement of the optical print head 130 with respect to the cover 300, the optical print head 130Y is described as an example. As described above, when the cover 300 is at the closed position, the optical print head 130Y is positioned between the developing cartridge 102Y and the developing cartridge 102M. A direction from the developing cartridge 102Y toward the developing cartridge 102M at this time is defined as "one direction", and a direction from the developing cartridge 102M toward the developing cartridge 102Y is defined as "the other direction". That is, the direction opposite to the "one direction" is the "the other direction". In other words, a direction from the developing cartridge 102Y of the process cartridge 202Y corresponding to the optical print head 130Y toward the developing cartridge 102M adjacent to the developing cartridge 102Y is the "one direction".

As illustrated in FIG. 5B, the operator can allow the optical print head 130 to pivot toward the front side of the main body housing 110 with the pivotal center axis K being the pivotal center. In other words, the operator can allow the optical print head 130 to pivot toward the one direction with the pivotal center axis K being the pivotal center. As a result, a light exit surface of the lens array 203 faces the front side of the main body housing 110, that is, the side on which the operator is located, and hence the operator can easily clean the light exit surface of the lens array 203. When the operator releases the optical print head 130, the optical print head 130 is allowed to pivot in a direction toward the stopper 902 by the spring 901. In other words, when the operator releases his/her hold of the optical print head 130 in the state in which the lens array 203 of the optical print head 130 faces the operator, the optical print head 130 pivots toward the other direction with the pivotal center axis K being the pivotal center. Then, the optical print head 130 pivoting toward the other direction abuts against the stopper 902 in the other direction. Therefore, even when dust settles at a connection portion between the optical print head 130 and the cover 300 to reduce slidability between the optical print head 130 and the cover 300, the optical print head 130 reliably abuts against the stopper 902 by the spring 901.

Figure 9:
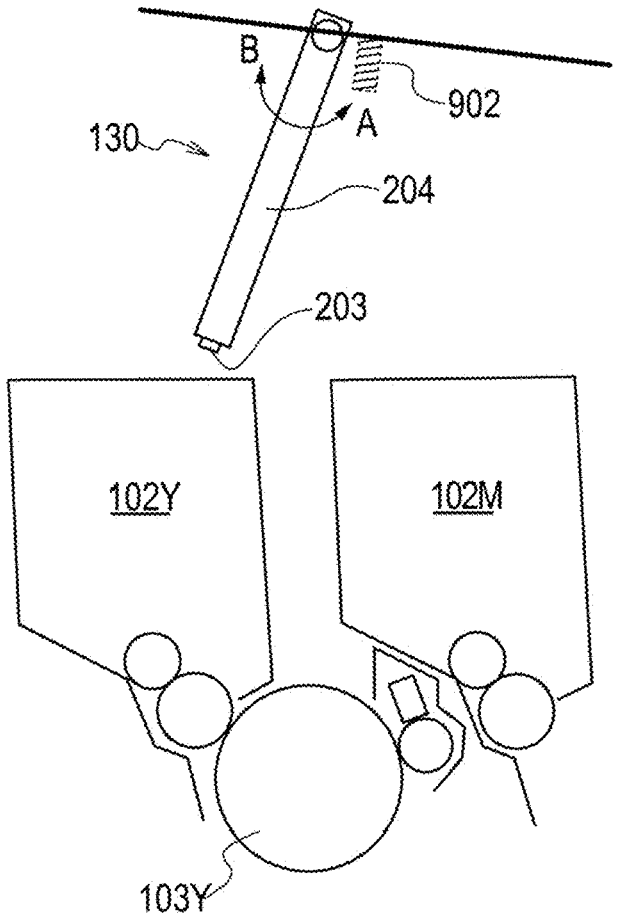
FIG. 9 is a view for illustrating a related-art structure without a spring configured to press an optical print head against a stopper.

Now, with reference to FIG. 9, effects of the spring 901 in this embodiment is described in comparison with a related-art example. FIG. 9 is a view for illustrating the related-art structure without a member corresponding to the spring 901 in this embodiment.

Without the presence of a member corresponding to the spring 901 of this embodiment, the optical print head 130 that has been allowed to pivot in a direction of the arrow B by the operator pivots toward a direction of the arrow A by its own weight to abut against the stopper 902. The "direction of the arrow B" is the "other direction" described above, and the "direction of the arrow A" is the "one direction" described above.

However, when foreign matter such as dust adheres to the connection portion between the optical print head 130 and the cover 300, the slidability of the optical print head 130 with respect to the cover 300 is reduced, and the optical print head 130 may stand still, for example, at the posture illustrated in FIG. 9. When the cover 300 pivots toward the closing direction in this state, there is a fear in that the optical print head 130 may not be fitted between the developing cartridge 102Y and the developing cartridge 102M. When the movement of the optical print head 130, which moves with the cover 300 that pivots from the open position to the closed position, is inhibited by the developing cartridge 102Y as described above, there is a fear in that, not only the optical print head 130 does not move to the exposure position, at which the photosensitive drum 103Y is exposed to light, but also the lens array 203 may be brought into contact with the developing cartridge 102Y and damage the developing cartridge 102Y.

As described above, in the case of the configuration in which the optical print head 130 moves toward the stopper 902 under the force of its own weight, the optical print head 130 may not move to the position at which the optical print head 130 abuts against the stopper 902.

FIG. 6 is a view for illustrating a function of the spring 901 and a function of the stopper 902. First, the structure and the function of the spring 901 are described in detail. In this embodiment, the spring 901 is what is called a torsion spring including a coil portion 901*c* and a pair of elastic arms 901*a* and 901*b*. A torsion spring is a spring in which two arms (elastic arms 901*a* and 901*b*) extend from the coil portion 901*c* in a shape of a helically-wound coil, and is used so that a load is applied to the two arms (elastic arms 901*a* and 901*b*) in a direction in which the coil portion 901*c* is coiled. In general, the torsion is also referred to as, for example, "kick spring" or "helical torsion spring".

As illustrated in FIG. 6, the elastic arm 901*a* is in contact with the housing 204 of the optical print head 130, and the elastic arm 901*b* is in contact with a part of the cover 300. In this example, the elastic arm 901*a* may be mounted to the housing 204 through intermediation of another member, or may be fixed with a bonding material or adhesive tape. The elastic arm 901*b* may also be mounted to a part of the cover 300 through intermediation of another member, or may be fixed with a bonding material or adhesive tape. In an example, the elastic arm 901*a* is always urged to open in a direction of the arrow A (one direction) in FIG. 6 with respect to the elastic arm 901*b*, which is in contact with a part of the cover 300. That is, the elastic arm 901*a* always presses the housing 204 against the cover 300 in the direction of the arrow A. Here, in this embodiment, the direction of the arrow A corresponds to the direction in which the cover 300 pivots from the open position to the closed position, and the direction of the arrow B, which is the direction opposite to the arrow A, corresponds to the direction in which the cover 300 pivots from the closing direction to the opening direction. However, as the embodiment, it is not always required that the direction in which the cover 300 pivots from the open position to the closed position match with the arrow A. Similarly, it is not always required that the direction in which the cover 300 pivots from the closing direction to the opening direction match with the direction of the arrow B.

Further, in this embodiment, a torsion spring is used as the spring 901, but the type of the spring 901 is not limited to the torsion spring. For example, a leaf spring may be warped, one end side of the leaf spring may be mounted to the housing 204, and another end side of the leaf spring may be mounted to the cover 300. Further, a coil spring may be bent, one end of the coil spring may be mounted to the housing 204, and another end side of the coil spring may be mounted to the cover 300. That is, the type of the spring is not limited as long as the force in the direction indicated by the arrow A in FIG. 6 is applied to the optical print head 130.

Further, in this embodiment, the force in the direction of the arrow A is applied to the housing 204 by the elastic arm 901*a*, which is a part of the spring 901, pressing the housing 204 toward the direction of the arrow A, but the force in the direction of the arrow A may be applied to the housing 204 by attracting the housing 204 in the direction of the arrow A. Specifically, the spring 901 may be arranged so that the elastic arm 901*b* in FIG. 6 is on the side on which the stopper 902 is arranged. In this case, the force is applied to the housing 204 with use of a force with which each of the pair of elastic arms 901*a* and 901*b* is pivoting in the direction in which the elastic arms 901*a* and 901*b* are attracted to each other by the coil portion 901*c*, that is, the direction in which the elastic arm 901*a* and the elastic arm 901*b* are brought closer to each other. With the elastic arm 901*a* pivoting toward the elastic arm 901*b* so that the elastic arm 901*a* is attracted to the elastic arm 901*b*, the elastic arm 901*a* pivots on the housing 204 toward the direction of the arrow A in FIG. 6.

As described above, the spring 901 has the function of allowing the optical print head 130 to pivot toward the direction of the arrow A in FIG. 6. As a result, when the cover 300 is allowed to pivot gradually from the open position to the closed position, the optical print head 130 is prevented from abutting against the developing cartridge 102 of the process cartridge 202 including the photosensitive drum 103 as the exposure target, and from moving to the position at which the photosensitive drum 103 as the exposure target is exposed to light. Specifically, taking the optical print head 130Y corresponding to yellow as an example, when the cover 300 is allowed to gradually pivot from the open position to the closed position, the optical print head 130Y is prevented from abutting against the developing cartridge 102Y, with the result that the movement of the optical print head 130Y with the pivotal movement of the cover 300 is not inhibited by the developing cartridge 102Y.

Next, the stopper 902 is described in detail. The stopper 902 in this embodiment is a member made of a resin and provided on the cover 300. The stopper 902 is fixed to the cover 300 with screws.

When the image forming apparatus 100 in this embodiment has a configuration without the stopper 902, the optical print head 130 that has been allowed to pivot toward the direction of the arrow A by the spring 901 pivots to a state in which a restoring force of the deformed spring 901 vanishes. Therefore, with the configuration without the stopper 902, when the cover 300 is allowed to gradually pivot from the open position to the closed position, there is a fear in that a part of the optical print head 130 may abut against the developing cartridge 102 of the process cartridge 202 next to the process cartridge 202 corresponding to the optical print head 130 of interest. Specifically, taking the optical print head 130Y corresponding to yellow as an example, when the cover 300 is allowed to gradually pivot from the open position to the closed position, there is a fear in that the optical print head 130Y may abut against the developing cartridge 102M, with the result that the movement of the optical print head 130Y with the pivotal movement of the cover 300 may be inhibited by the developing cartridge 102M. The stopper 902 plays a role of restricting an amount of pivotal movement of the optical print head 130Y through abutment against the optical print head 130Y that is allowed to pivot in the direction of the arrow A by the force applied by the spring 901.

Figure 7:
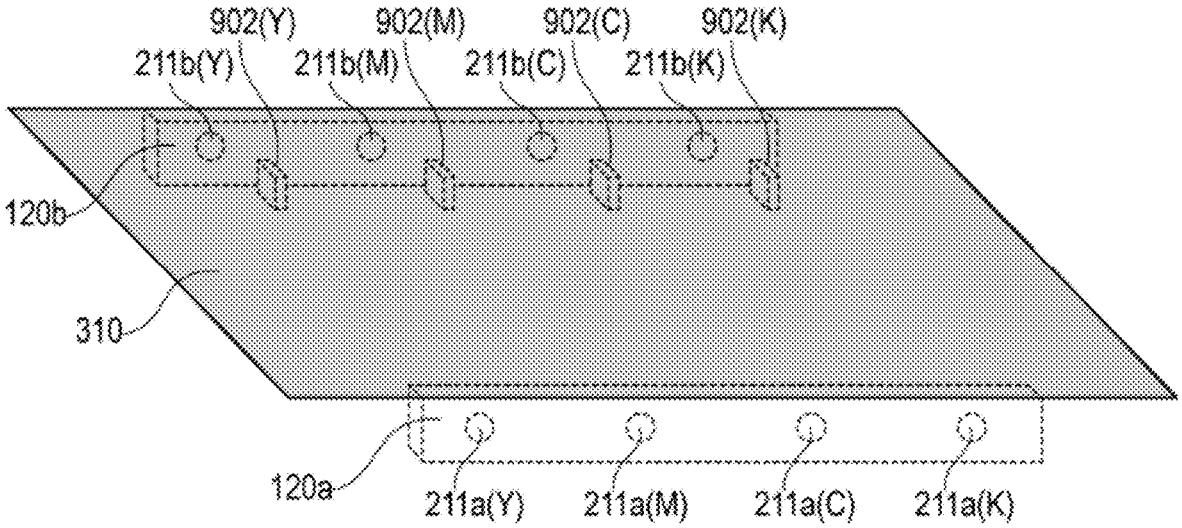
FIG. 7 is a view for illustrating mounting positions of stoppers.

First, a portion of the cover 300 to which the stopper 902 is mounted is specifically described. FIG. 7 is a view for illustrating placement positions of the stoppers 902. In this embodiment, the cover 300 includes a ceiling frame 310 made of metal for increasing its stiffness. The ceiling frame 310 made of metal is, for example, a rectangular aluminum plate. The ceiling frame 310 includes a first frame 120*a* and a second frame 120*b*. The ceiling frame 310, the first frame 120*a*, and the second frame 120*b* form a part of the cover 300. In other words, the ceiling frame 310, the first frame 120*a*, and the second frame 120*b* are a part of the cover 300. Those members may all be integrally molded, or may be separate members and fixed to each other with screws.

The first frame 120*a* is a bar-shaped frame extending from the back side toward the front side of the main body housing 110. The first frame 120*a* has holes 211*a*, to which the projections 210*a* provided on the housings 204 are to be fitted. The holes 211*a* are formed at four positions in total, and correspond to the projections 210*a* provided on the housings 204 of the optical print heads 130, respectively. Further, the second frame 120*b* is a bar-shaped frame extending from the back side toward the front side of the main body housing 110. The second frame 120*b* has holes 211*b*, to which the projections 210*b* provided on the housings 204 are to be fitted. The holes 211*b* are formed at four positions in total, and correspond to the projections 210*b* provided on the housings 204 of the optical print heads 130, respectively. Now, a configuration of mounting portions of the optical print head 130Y corresponding to yellow (Y) to the first frame 120*a* and the second frame 120*b* is described. The same applies to configurations of mounting portions of the optical print heads 130 corresponding to the other colors (M, C, and K) to the first frame 120*a* and the second frame 120*b*.

As described above, the projection 210*a* provided on the housing 204 of the optical print head 130Y is fitted to the hole 211*a* of the first frame 120*a*. Further, the projection 210*b* provided on the housing 204 of the optical print head 130Y is fitted to the hole 211*b* of the second frame 120*b*. A center axis of the projection 210*a* matches with a center axis of the projection 210*b*. The center axis is the pivotal center axis K in FIG. 6. With this configuration, the optical print head 130 pivots with respect to the first frame 120*a* and the second frame 120*b* with the pivotal center axis K being the pivotal center.

As illustrated in FIG. 7, in this embodiment, stoppers 902 are provided on the second frame 120*b*. The stoppers 902 are provided at four positions in total to correspond to the optical print heads 130 of the respective colors, respectively. The stoppers 902 and the second frame 120*b* may be an integrated member, or may be separate members to be fixed to each other with screws. Here, in order to simplify the description, only the stopper 902(Y) corresponding to yellow is described in detail.

As illustrated in FIG. 7, the stopper 902(Y) is a projection projecting from the second frame 120*b* toward the first frame 120*a*. A lower end of the stopper 902(Y) is located on a lower side of a line connecting the pivotal center axis K of the optical print head 130Y and a pivotal center axis of the optical print head 130M. Therefore, when the optical print head 130Y pivots with the pivotal center axis K being the pivotal center, a part of the housing 204 abuts against the stopper 902(Y). As a result, the amount of pivotal movement of the optical print head 130Y is restricted. Here, the stopper 902(Y) may have a function of absorbing impact at the time when the housing 204 abuts against the stopper 902(Y), for example, by bonding a rubber sheet on a surface of the stopper 902(Y) on the optical print head 130Y side. With this configuration, even when the operator allows the optical print head 130Y to pivot toward the front side and releases his/her hold of the optical print head 130Y, for example, the risk of damage on the stopper 902(Y) by impact of the optical print head 130Y abruptly abutting against the stopper 902(Y) can be reduced. When the rubber sheet is bonded on the stopper 902(Y), for example, the optical print head 130 is allowed to move slightly by cushioning of the rubber sheet in the state of being in contact with the stopper 902(Y). Even in this state, the optical print head 130Y can be said to be in the state of abutting against the stopper 902(Y) so that its pivotal movement is restricted.

In addition to the above-mentioned embodiment, for example, there may be adopted a configuration in which the stoppers 902 are mounted to the second frame 120*b* through intermediation of springs to be movable by from about 1 mm to about 5 mm along a longitudinal direction of the second frame 120*b*. When the optical print heads 130 are pressed against the stoppers 902 by the springs 901, both of the optical print heads 130 and the stoppers 902 are moved in the longitudinal direction of the second frame 120*b*. A movable amount of the stoppers 902 with respect to the second frame 120*b* is restricted. The amount of pivotal movement of the optical print heads 130 with respect to the cover 300 may be restricted in this manner.

Further, in this embodiment, the stopper 902(Y) is provided on the second frame 120*b* but not on the first frame 120*a*. However, as a matter of course, the first frame 120*a* may also include the stopper 902(Y). In this case, the optical print head 130Y having a force applied thereto by the spring 901 abuts against the stopper 902(Y) provided on the first frame 120*a* and the stopper 902(Y) provided on the second frame 120*b*. The optical print head 130Y is thus positioned with respect to the cover 300. Further, there may be adopted a configuration in which the first frame 120*a* includes the stopper 902(Y), and in which the second frame 120*b* does not include the stopper 902(Y).

In this embodiment, the configuration in which the stopper 902(Y) is provided on the second frame 120*b* is adopted, but, for example, a configuration in which the stopper 902(Y) is provided on the ceiling frame 310 may be adopted. In short, it is only required that the stopper 902 be fixed to the cover 300 and have the function of restricting the pivotal movement of the optical print head 130 applied with the force by the spring 901.

To summarize the above description, the spring 901 always presses the optical print head 130 in the direction (one direction) indicated by the arrow A in FIG. 6 with respect to the cover 300 in an example. As a result, the optical print head 130 always abuts against the stopper 902 fixed to the cover 300 toward the closing direction. The operator allows the optical print head 130 to pivot toward the direction opposite to the direction of the arrow A against the force of the spring 901 for allowing the optical print head 130 to pivot toward the direction of the arrow A, to thereby clean the light exit surface of the lens array 203.

(Positional Relationship Between Optical Print Head and Process Cartridge)

Figure 8A:
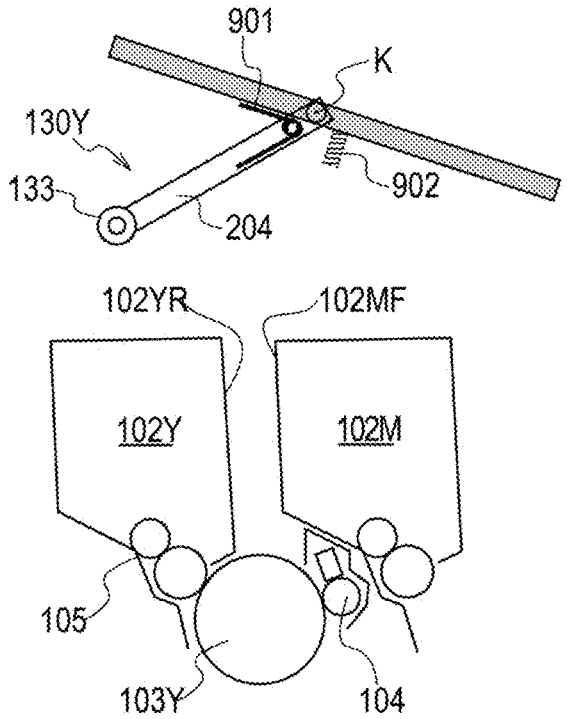
FIG. 8A and FIG. 8B are views for illustrating a positional relationship between the optical print head, which is moved along with pivotal movement of the cover, and developing cartridges.
Figure 8B:
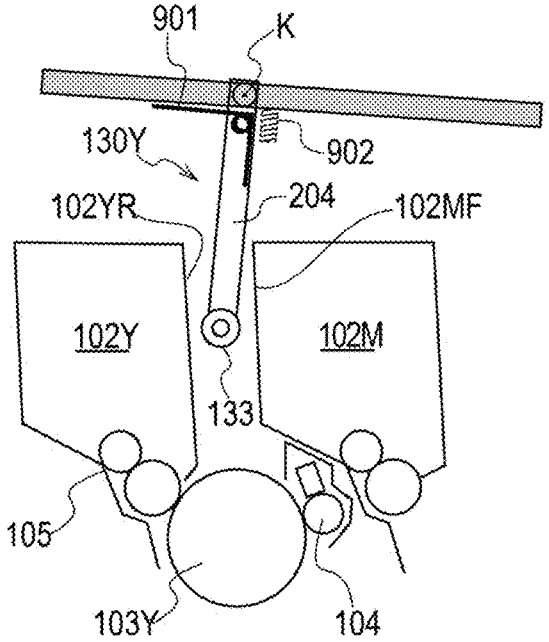

Next, with reference to FIG. 8A and FIG. 8B, the positional relationship between the optical print head 130 and the process cartridge 202 is described.

FIG. 8A is a view for illustrating a state in which, in the state in which the cover 300 is at the open position, the operator have held the housing 204 of the optical print head 130Y with his/her hand to allow the optical print head 130Y to pivot, with the pivotal center axis K being the pivotal center, toward the front side, that is, the side on which the operator himself/herself is located. In this state, the lens array 203, which is not shown in FIG. 8A, faces the operator side, and hence the operator can easily clean the light exit surface of the lens array 203. As illustrated in FIG. 8A, the spring 901 is deformed at this time, and the restoring force of the spring 901 is applied to the housing 204. When the operator releases his/her hold of the housing 204 in this state, the optical print head 130Y pivots toward the stopper 902 by the restoring force of the spring 901.

FIG. 8B is a view in which, in the state in which the housing 204 of the optical print head 130Y abuts against the stopper 902 to position the optical print head 130 with respect to the cover 300, the cover 300 is allowed to pivot from the open position to the closed position. As illustrated in FIG. 8B, the rotary members 133 provided on the photosensitive drum 103Y side of the housing 204 are in non-contact with a side wall portion 102YR, which is a side wall on the back side of the developing cartridge 102Y, and a side wall portion 102MF, which is a side wall on the front side of the developing cartridge 102M. Although the cover 300 pivots to move from the open position toward the closed position, no part of the optical print head 130 including the rotary members 133 is brought into contact with the side wall portion 102YR and the side wall portion 102MF during the movement. Therefore, although the optical print head 130Y is also moved to the position at which the photosensitive drum 103Y is exposed to light along with the movement of the cover 300 from the open position toward the closed position, the movement is not inhibited by the side wall portion 102YR and the side wall portion 102MF.

As described above, the stopper 902 has the function of positioning the optical print head 130Y with respect to the cover 300 so that the movement of the optical print head 130Y with the pivotal movement of the cover 300 is not inhibited by the side wall portion 102YR and the side wall portion 102MF. When the cover 300 is at the open position, the optical print head 130 is positioned on the upper side of the opening 220 in the vertical direction. At this time, unless the operator touches the optical print head 130, the optical print head 130 is pressed against the stopper 902 by the spring 901 to be positioned with respect to the cover 300. Even when the cover 300 pivots in the state in which the optical print head 130 is positioned with respect to the cover 300 by the stopper 902, the optical print head 130Y does not abut against the developing cartridge 102Y and the developing cartridge 102M, with the result that the movement of the optical print head 130Y along with the movement of the cover 300 is not inhibited. In other words, the spring 901 prevents the movement of the optical print head 130Y with the pivotal movement of the cover 300 from being inhibited by the side wall portion 102YR, and the stopper 902 prevents the movement of the optical print head 130Y with the pivotal movement of the cover 300 from being inhibited by the side wall portion 102MF.

In this example, as described above, when the optical print head 130 abuts against the stopper 902 through intermediation of the rubber sheet or other member with cushioning, the optical print head 130 is allowed to move slightly in the state of abutting against the stopper 902. In this case, the optical print head 130, which moves along with the cover 300 pivoting from the open position toward the closed position, may be brought into contact with the side wall portion 102YR through intermediation of the rotary members 133, for example. With the rotary members 133, even when the optical print head 130 moves while rubbing the side wall portion 102YR, the optical print head 130 hardly receives a reactive force, and hence the movement of the optical print head 130Y is not inhibited by the developing cartridge 102Y. In the case in which the contact between the optical print head 130 and the developing cartridge 102 is allowed as described above within a range in which the movement of the optical print head 130 with the pivotal movement of the cover 300 is not inhibited, when the housing 204 does not include the rotary members 133, for example, a member for abutment is separately provided to the housing 204 instead of the rotary members 133.

As a matter of course, the developing cartridge 102 of the process cartridge 202 mounted on the main body housing 110 is desirably not located on a movement path along which the optical print head 130 moves along with the pivotal movement of the cover 300. Specifically, taking the optical print head 130Y corresponding to yellow as an example, the developing cartridge 102Y or the developing cartridge 102M is desirably not located on a movement path along which the optical print head 130Y moves along with the pivotal movement of the cover 300.

As described above, when the cover 300 is allowed to pivot from the open position toward the closed position, the optical print head 130 provided to the cover 300 also moves along with the cover 300. At this time, the optical print head 130 is positioned with respect to the cover 300 by the stopper 902. With the optical print head 130 being thus positioned, even when the cover 300 pivots toward the closing direction, and the optical print head 130 is moved toward the position at which the photosensitive drum 103 is exposed to light, the movement of the optical print head 130 is not inhibited by the developing cartridges 102. In other words, when the optical print head 130 is positioned with respect to the cover 300 through abutment against the stopper 902, even when the cover 300 is allowed to pivot and the optical print head 130 is moved, the movement of the optical print head 130 is not inhibited by the developing cartridges 102. That is, when the force toward the closing direction is applied to the optical print head 130 by the spring 901, and the state in which the optical print head 130 abuts against the stopper 902 is maintained, the cover 300 may be allowed to pivot toward the closing direction to reliably move the optical print head 130 to the position at which the photosensitive drum 103 is exposed to light.

According to this embodiment, even in a case in which the operator has allowed the optical print head to pivot with respect to the cover in order to clean the optical print head, for example, when the operator releases his/her hold of the optical print head, the optical print head returns to a predetermined position by the spring. Therefore, while the optical print head moves to the position at which the photosensitive drum is exposed to light with the pivotal movement of the cover from the open position to the closed position, the movement is not inhibited by the developing cartridges.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-227474, filed Dec. 4, 2018, which is hereby incorporated by reference herein in its entirety.

What is claimed is:

1. An image forming apparatus, comprising:

a first replacement unit which has a first photosensitive member and is replaceable;

a second replacement unit which has a second photosensitive member and is replaceable;

a housing to which the first replacement unit and the second replacement unit are mounted, the first replacement unit and the second replacement unit being mounted to the housing through an opening formed in an upper portion of the housing, and the second replacement unit being on a far side than the first replacement unit in the housing and adjacent to the first replacement unit;

a cover which is pivotably provided on the upper portion of the housing to open and close the opening, the cover being pivotable around a pivotal center on the far side of the housing;

an LED exposure head which is provided on the cover to expose the first photosensitive member from above, the LED exposure head being pivotable by a user toward a direction in which the cover is opened with respect to the cover in an open state; and a posture regulation mechanism which regulates a posture of the LED exposure head with respect to the cover so that the LED exposure head becomes a posture to be insertable into between the first replacement unit and the second replacement unit when the cover is to be closed.

2. The image forming apparatus according to claim 1, wherein the posture regulation mechanism comprises:

an elastic member configured to apply a force to the LED exposure head so as to rotate the LED exposure head in a direction in which the cover is closed; and a stopper configured to stop the LED exposure head rotated by the force.

3. The image forming apparatus according to claim 2, wherein the elastic member comprises a spring.

4. The image forming apparatus according to claim 1, further comprising an endless belt which is disposed opposite to the first photosensitive member and the second photosensitive member and conveys a recording sheet, wherein the first replacement unit includes a developing device configured to develop an electrostatic latent image, formed on the first photosensitive member by exposing the first photosensitive drum by the LED exposure unit, using toner into a toner image, and wherein the toner image developed by the developing device is transferred to the recording sheet, conveyed by the endless belt, through the first photosensitive member.

5. The image forming apparatus according to claim 3, wherein the spring is in contact with the cover and the LED exposure head.

6. The image forming apparatus according to claim 3, wherein the spring is a torsion spring including a coil portion and a pair of arms, and wherein one arm of the pair of arms is in contact with the cover and another arm of the pair of arms is in contact with the LED exposure head so that the another arm presses the LED exposure head toward the direction in which the cover is closed.

7. The image forming apparatus according to claim 1, wherein one end and another end of the LED exposure head in a longitudinal direction of the LED exposure head abut against the first replacement unit so that a gap is formed between a light emitting surface and the first photosensitive member.

8. The image forming apparatus according to claim 2, wherein the stopper and the LED exposure head are out of contact with each other in a state in which the cover is closed.

* * * * *